US006259197B1

(12) United States Patent
Leemans

(10) Patent No.: US 6,259,197 B1
(45) Date of Patent: Jul. 10, 2001

(54) CATHODE RAY TUBE COMPRISING AN ELECTRON GUN

(75) Inventor: Martinus J. J. M. Leemans, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/326,507

(22) Filed: Jun. 4, 1999

(30) Foreign Application Priority Data

Jun. 9, 1998 (EP) ..... 98201922

(51) Int. Cl.[7] ..... H01J 29/48

(52) U.S. Cl. ..... 313/446; 313/412; 313/414; 313/428; 313/439

(58) Field of Search ..... 313/414, 412, 313/444, 452, 460, 428, 439; 445/29, 35, 46

(56) References Cited

U.S. PATENT DOCUMENTS 5,300,855 * 4/1994 Kweon ..... 313/414
5,828,191 * 10/1998 Shirai et al. ..... 313/414 X
5,986,394 * 11/1999 Jeon et al. ..... 313/414

FOREIGN PATENT DOCUMENTS 0265683 11/1990 (EP) ..... H01J/29/56

* cited by examiner

*Primary Examiner*—Ashok Patel

(57) ABSTRACT

A cathode ray tube (1) includes an electron gun (6). The electron gun includes lens electrodes (25A) which contact nearby electrode parts (25B) in only two regions (50, 51). As a result, tilting of the lens electrodes (25A) is reduced or precluded.

6 Claims, 4 Drawing Sheets

CATHODE RAY TUBE COMPRISING AN ELECTRON GUN

BACKGROUND OF THE INVENTION

The invention relates to a cathode ray tube comprising an in-line electron gun with means for generating electrons and a lens system including two facing lens electrodes having apertures for allowing passage of electrons.

Such cathode ray tubes are known and are employed, inter alia, for television receivers and computer monitors.

In such a cathode ray tube, three electron beams are generated in the in-line electron gun, which electron beams extend in one plane, the in-line plane. These electron beams are deflected across a display screen in two mutually perpendicular directions by means of a deflection means. A color selection electrode, for example a shadow mask, is situated between the electron gun and the display screen. The electron gun accommodates a lens system having two lens electrodes between which, in operation, an electron-optical lens is formed. Customarily, the electron gun comprises a main lens system by means of which the electron beams are focused on the display screen, and the electron gun further comprises a pre-focusing lens system which is situated between the main lens system and the means for generating electrons.

Of great importance for the quality of the picture display is the quality of the lens system or lens systems. Relatively small deviations in the electron-optical lenses formed in and by the lens systems may adversely affect the picture quality.

OBJECTS AND SUMMARY OF THE INVENTION

It is an object of the invention to provide a cathode ray tube having a means for improving the picture quality.

To achieve this, a cathode ray tube in accordance with the invention is characterized in that inside the electron gun, an electrode part lies against at least one of the lens electrodes, said lens electrode and the electrode part contacting each other in only two regions, on either side of the in-line plane or on either side of a plane transverse to the in-line plane and through a central aperture.

The electron-optical lenses form, in operation, between the lens electrodes and, in particular, between the apertures in the lens electrodes.

The distance between and the orientation of the facing apertures of the lens electrodes also determine the electron-optical properties (such as the strength of a lens and the astigmatism of the lens) of the lenses. In the manufacture of the electron gun, a number of electrodes and electrode parts are stacked, spacers being positioned between electrodes. A problem which relates thereto and which has been recognized by the inventors is that, in known cathode ray tubes, a lens electrode may be pushed out of alignment by an engaging electrode or electrode part, thus causing the lens electrode to assume an oblique position relative to the second lens electrode facing said lens electrode. As a result, undesirable differences occur between the lenses for the outer electrodes and/or an astigmatic deviation in the lenses occurs.

In the cathode ray tube in accordance with the invention, the lens electrode and the electrode part contact each other in only two regions, on either side of the in-line plane or on either side of a plane transverse to the in-line plane and through a central aperture. The forces exerted by the engaging part on the lens electrode are symmetrical relative to planes of symmetry of the apertures of the lens. As a result, the risk that the lens electrode is pushed out of alignment by the electrode part in the course of the manufacturing process is reduced, so that the electron-optical properties of the lens improve. The invention also relates to a method of manufacturing an electron gun, in which electrodes are stacked and separated from each other by spacers, characterized in that at least one of the spacers comprises two regions projecting from the plane of the spacer, which regions are situated on either side of the in-line plane or on either side of a plane transverse to the in-line plane and through a central aperture.

These and other aspects of the invention will be apparent from and elucidated with reference to the embodiments described hereinafter.

BRIEF DESCRIPTION OF THE DRAWINGS

In the drawings.

The Figures are not drawn to scale. In the Figures, like reference numerals generally refer to like parts.

DESCRIPTION OF THE PREFERRED EMBODIMENTS

Figure 1:
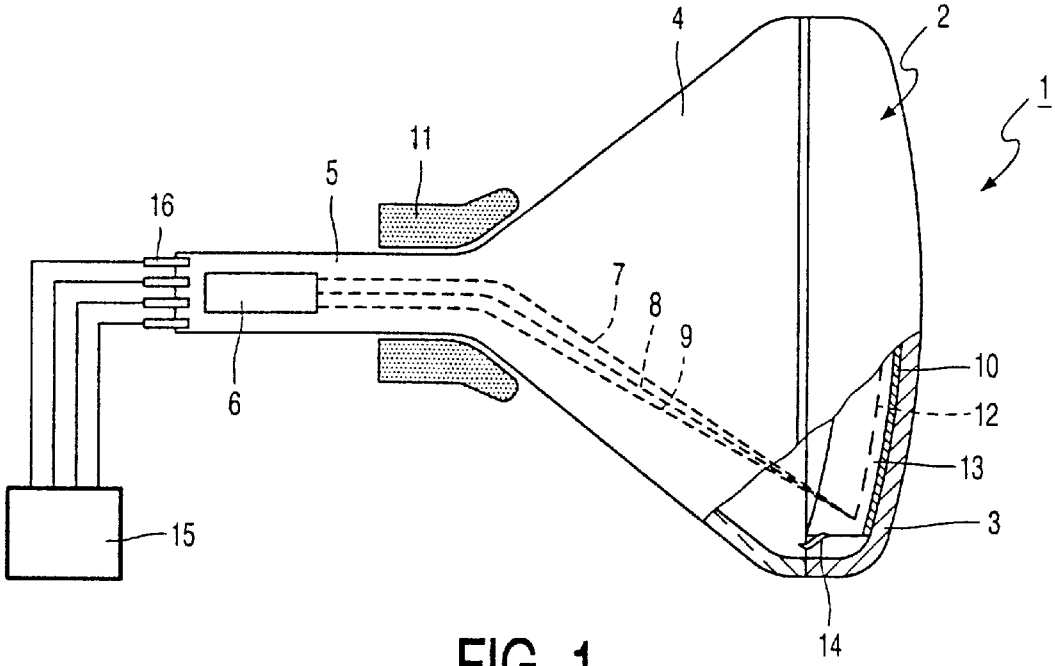
FIG. 1 is a sectional view of a cathode ray tube.

A cathode ray tube 1, in this example a color display tube, comprises an evacuated envelope 2, which includes a display window 3, a cone portion 4 and a neck 5. Said neck 5 accommodates an electron gun 6 for generating three electron beams 7, 8 and 9 which are situated in one plane, the in-line plane, which in this case is the plane of the drawing. In the undeflected state, the central electron beam 8 approximately coincides with the tube axis. The inner surface of the display window is provided with a display screen 10. Said display screen 10 comprises a large number of phosphor elements luminescing in red, green and blue. On their way to the display screen, the electron beams are deflected across the display screen 10 by means of an electromagnetic deflection unit 11 and pass through a color selection electrode 12 which is arranged in front of the display window 2 and which comprises a thin plate having apertures 13. The three electron beams 7, 8 and 9 pass through the apertures 13 of the color selection electrode at a small angle with respect to each other and, consequently, each electron beam impinges only on phosphor elements of one color. Further, during operation, means 15 for generating voltages are coupled to the cathode ray tube, which supply voltages, via feedthroughs 16, to parts of the electron gun.

Figure 2:
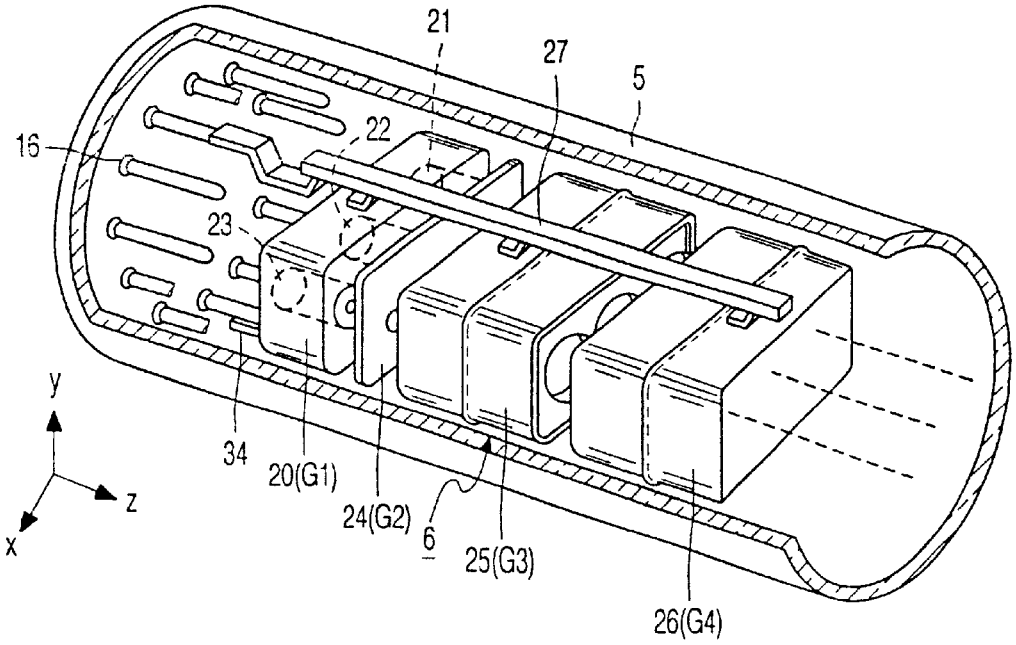
FIG. 2 shows an electron gun of the cathode ray tube shown in FIG. 1.

FIG. 2 is an elevational view of an electron gun 6. Said electron gun comprises three cathodes 21, 22 and 23. The electron gun further includes a first common electrode 20 ($G_1$), a second common electrode 24 ($G_2$), a third common electrode 25 ($G_3$) and a fourth common electrode 26 ($G_4$). The electrodes have connections for applying electric voltages. The display device comprises lines, not shown in the drawing, for supplying electric voltages to the electrodes, which voltages are generated in the means 15. By applying electric voltages, and particularly by differences in electric voltages between electrodes and/or sub-electrodes, electron-optical fields are generated. Electrode 26 ($G_4$) and sub-electrode 25 (G3) form an electron-optical element for generating a main lens field which, in operation, is formed between these electrodes. The electrodes are interconnected by means of connecting elements, in this example glass rods 27.

FIG. 3 shows a number of parts of a known electron gun.

In operation, a lens is formed between the electrodes 26 and 25A. In the course of the manufacture of the electron gun, parts 25 and 26 are stacked and pressed together, a spacer 41 being arranged between them. The thickness d of the spacer determines the distance between the electrodes. The force with which the electrodes are pressed together is indicated in the Figure by means of arrows F. As shown in the Figure, it may occur that the magnitude of this force is not the same everywhere, but instead, for example smaller on the left than on the right ($F_R>F_L$). This may cause the spacer to be pressed out of alignment or, if the spacer 41 is removed, there may be a difference in distance between the electrodes 25 and 26 ($d_l$<or>$d_r$). Apart from the effects which may occur in the course of the manufacture, also a thermal effect may occur in the manufacture and/or during operation of the cathode ray tube. As a result of temperature differences, stresses may develop in the electrodes or electrode parts. As a result, the position and/or orientation of the electrode part 25B may change, thus causing the part 25A to be pressed or pulled out of alignment. Such effects too adversely affect the picture quality.

Figure 4:
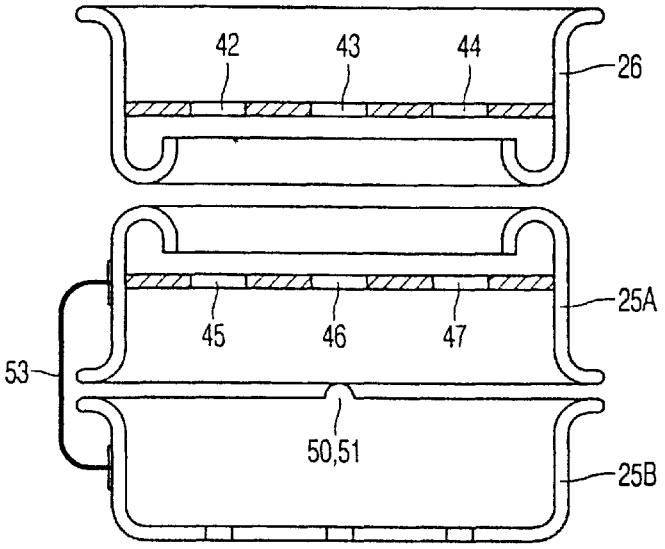
FIGS. 4 and 5 show parts of an electron gun in accordance with an embodiment of the invention.
Figure 5:
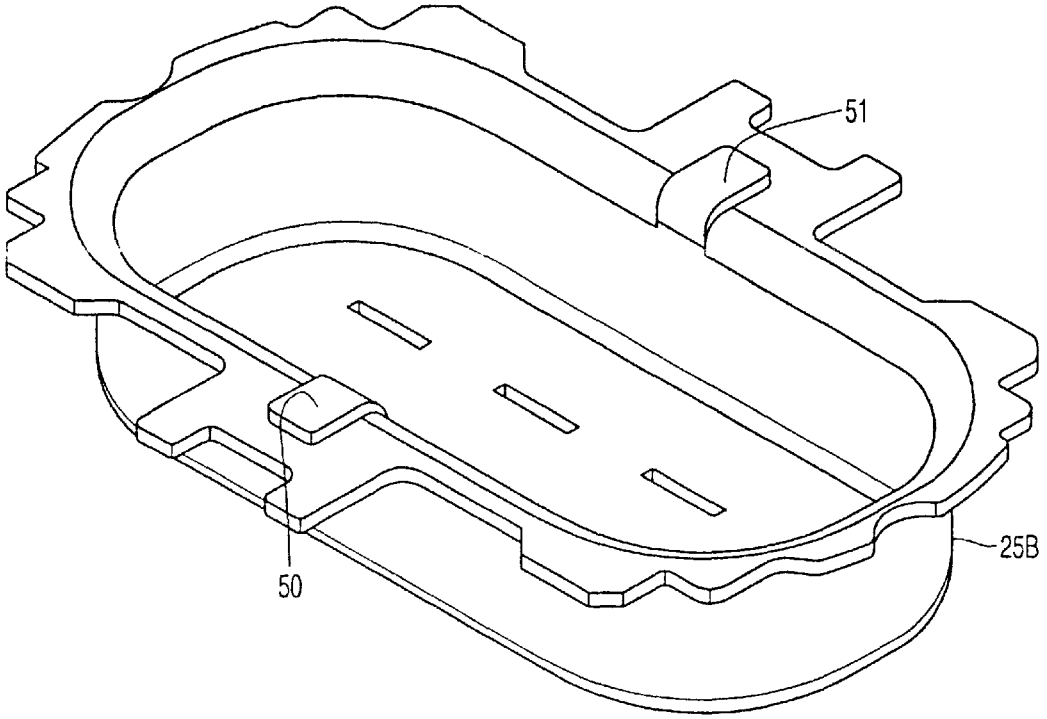

FIG. 4 is a sectional view of a number of parts of an electron gun of a cathode ray tube in accordance with the invention. Part 25B engages the lens electrode 25A only with raised portions 50, 51. FIG. 5 shows part 25B in a perspective view. The forces exerted, in the course of the manufacture or in operation, by part 25B on the lens electrode 25 extend in the plane through the raised portions 50–51 and are incapable of tilting the lens electrode 25A. The same effect can be achieved by arranging, in the course of the manufacture, a spacer having projections at points 50–51 between the parts 25A and 25B. To ensure that there is good electric contact between the parts 25A and 25B, in the example shown in FIG. 4, an electroconductive element 53 is connected to both parts.

Figure 3A:
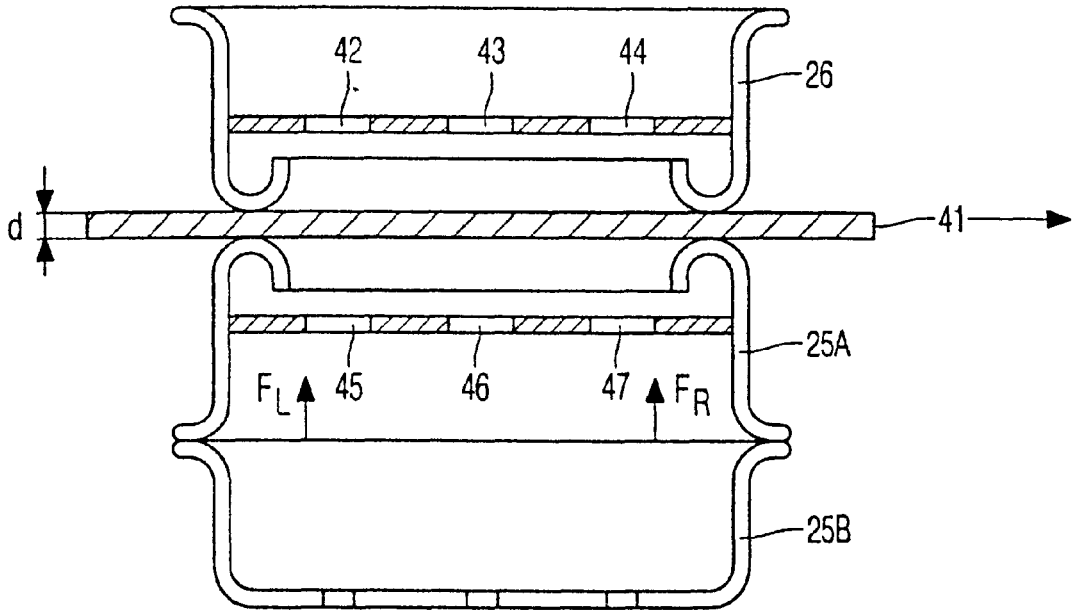
FIGS. 3A and 3B show a number of parts of a known electron gun.
Figure 3B:
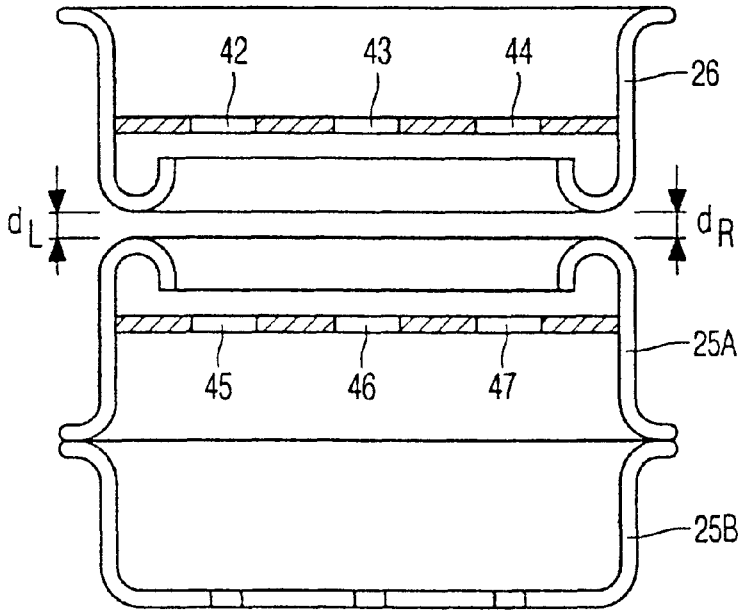

As a result, the variation in the distances $d_l$ and/or $d_r$ and hence in the distances between the electrodes 26 and 25A are smaller than in the known electron gun as shown in FIGS. 3A and 3B. The height of the raised portions 50, 51 preferably ranges between 50 $\mu$m and 200 $\mu$m. Said height determines the distance between the electrode 25A and part 25B. If the distance is above 200 $\mu$m, it may occur that electric fields situated outside the electrode, which may develop as a result of electric charging of the neck, influence the electric field inside the electrode. If the distance is below 50 $\mu$m, it may occur that the electrode 25A and part 25B lie against each other at a location other than the raised portions 50–51.

Figure 6:
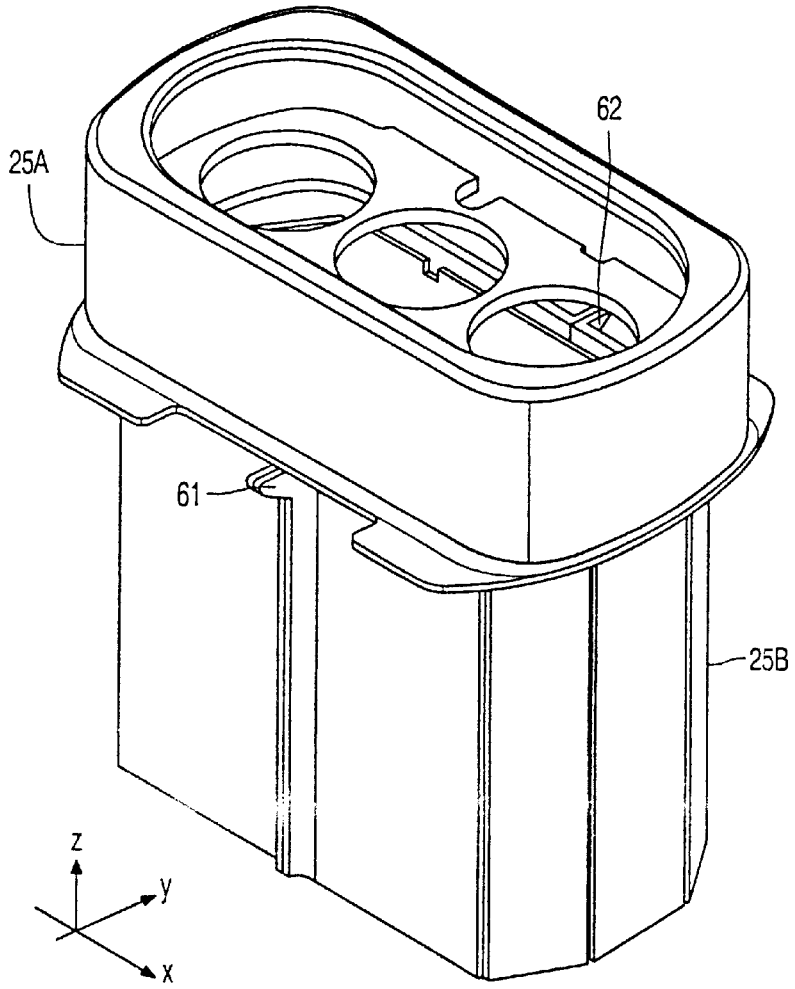
FIGS. 6 and 7 show parts of an electron gun in accordance with an embodiment of the invention.
Figure 7:
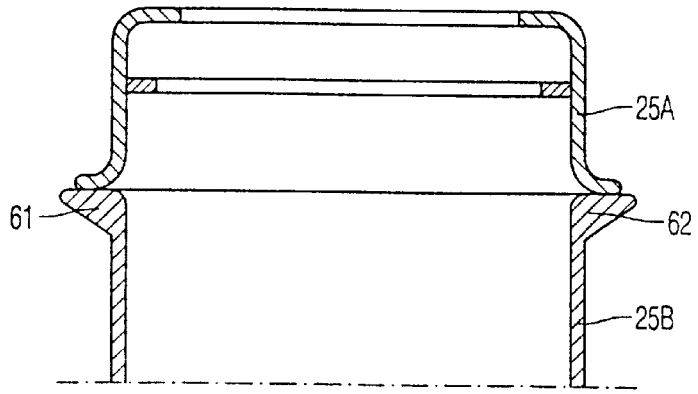

FIGS. 6 and 7 are a perspective view and a sectional view, respectively, of parts of a further embodiment of an electron gun of a cathode ray tube in accordance with the invention. Projections 61 and 62 of part 25B project sideways in these embodiments. The embodiments shown in FIGS. 4, 5, 6 and 7 show lens electrodes of a main lens, the regions where the lens electrodes and the electrode part lie against each other being situated in a plane transverse to the in-line plane. As a result, tilting of the lens electrode 25A relative to part 25B is reduced.

It will be obvious that within the scope of the invention many variations are possible. In the examples given above, the lens electrode and the electrode part contact each other in two regions on either side of the in-line plane (points 50 and 51; 60 and 61). As a result, tilting about an imaginary line through said points is precluded, said line passing through the central aperture. Particularly in the pre-focusing part tilting about an imaginary line through the centers of in-line apertures may cause problems. In embodiments, a (pre-focusing) lens electrode and an adjacent electrode part contact each other only in two regions on either side of a plane transverse to the in-line plane, which plane passes through the central aperture, an imaginary line through both regions passing through the in-line apertures.

What is claimed is:

1. A cathode ray tube comprising an in-line electron gun with means for generating electrons and a lens system including two facing lens electrodes having apertures for allowing passage of electrons, characterized in that inside the electron gun, an electrode part lies against at least one of the lens electrodes, said lens electrode and the electrode part contacting each other in only two regions, which regions are situated on either side of the in-line plane or on either side of a plane transverse to the in-line plane and through a central aperture.

2. A cathode ray tube as claimed in claim 1, characterized in that the lens electrode constitutes a lens electrode of a main lens, and the regions are situated on either side of the in-line plane.

3. A cathode ray tube as claimed in claim 1, characterized in that the lens electrode constitutes a lens electrode of a pre-focusing lens, and the regions are situated on either side of a plane transverse to the in-line plane and through a central aperture.

4. A cathode ray tube as claimed in claim 1, characterized in that the electrode part is provided with raised portions (50, 51), and the lens electrode lies against said raised portions.

5. A cathode ray tube as claimed in claim 4, characterized in that the height of the raised portions ranges between 50 $\mu$m and 200 $\mu$m.

6. A cathode ray tube as claimed in claim 1, characterized in that the electrode part is provided with projections (60, 61).

* * * * *